United States Patent [19]

Hiromae et al.

[11] 4,287,006

[45] Sep. 1, 1981

[54] ANNEALING SEPARATOR FOR GRAIN ORIENTED SILICON STEEL STRIPS

[75] Inventors: Yoshitaka Hiromae; Kazuo Nakamura; Hajime Nitto, all of Kitakyushu, Japan

[73] Assignee: Nippon Steel Corporation, Tokyo, Japan

[21] Appl. No.: 98,118

[22] Filed: Nov. 27, 1979

[30] Foreign Application Priority Data

| | | | |
|---|---|---|---|
| Nov. 28, 1978 | [JP] | Japan | 53/146101 |
| Apr. 11, 1979 | [JP] | Japan | 54/42961 |
| Jun. 7, 1979 | [JP] | Japan | 54/70569 |
| Aug. 22, 1979 | [JP] | Japan | 54/106799 |

[51] Int. Cl.[3] ..... C04B 35/04; B23K 35/24

[52] U.S. Cl. ..... 148/27; 148/113; 106/58; 106/62

[58] Field of Search ..... 148/113, 27; 106/58, 106/62

[56] References Cited

U.S. PATENT DOCUMENTS

| | | | |
|---|---|---|---|
| 3,583,887 | 6/1971 | Steger et al. | 148/27 |
| 3,697,322 | 10/1972 | Lee et al. | 148/113 |
| 3,768,990 | 10/1973 | Sellers et al. | 106/62 |
| 3,956,029 | 5/1976 | Yamamoto et al. | 148/27 |
| 4,033,778 | 7/1977 | Gildin et al. | 106/58 |
| 4,073,662 | 2/1978 | Borom | 134/2 |
| 4,096,000 | 6/1978 | Wada et al. | 148/27 |
| 4,126,479 | 11/1978 | Videtto | 106/62 |
| 4,140,534 | 2/1979 | Brodmann et al. | 106/58 |

*Primary Examiner*—Upendra Roy

*Attorney, Agent, or Firm*—Cushman, Darby & Cushman

[57] ABSTRACT

An annealing separator useful for producing a grain oriented silicon steel strip having an excellent magnetic property, comprises non-hydrating magnesium oxide which has been calcined at a temperature of 1300° C. or more, preferably, from 1300° to 2100° C., and which is in the form of fine particles, 70% by weight of which have a size of 5 microns or less, and optionally, magnesium hydroxide in an amount of 1 to 100% based on the weight of the magnesium oxide and/or an aluminium compound in an amount of 0.05 to 10% based on the weight of the magnesium oxide.

10 Claims, 5 Drawing Figures

ANNEALING SEPARATOR FOR GRAIN ORIENTED SILICON STEEL STRIPS

FIELD OF THE INVENTION

The present invention relates to an annealing separator for grain oriented silicon steel strips. More particularly, the present invention relates to an annealing separator which is effective for causing a plurality of grain oriented silicon steel strips tightly wound on a core to be finish annealed without the silicon steel strips sticking to each other and also, without deterioration in the magnetic property of the silicon steel strips.

BACKGROUND OF THE INVENTION

It is known that a grain oriented silicon steel strip exhibits a high degree of orientation of grains in a direction of an axis <001>, in which direction the steel strip can be easily magnetized, and therefore, is a magnetic material useful for producing steel cores of motors or transformers.

The grain oriented silicon steel strip is usually produced by a process comprising a steel-making step, hot rolling step, cold rolling step, decarburization step and finish annealing step. In the finish annealing step, the decarburized silicon steel strip which has been converted into a plurality of strips having a desired shape, is annealed in a reduction atmosphere at a temperature of from 1100° to 1300° C. In order to feed the steel strip to the finish annealing step, the pieces are coated with an annealing separator so as to prevent them from sticking to each other. Usually, the annealing separator comprises a conventional type of magnesium oxide. The magnesium oxide can exhibit an excellent resistance to heat. The annealing separator is not only effective for preventing the pieces of the steel strip from sticking to each other, but also, is influential in secondary recrystallization of the grains and in formation of a glassy insulating film on the surfaces of the steel strips during the finish annealing operation. Therefore, in order to produce a finish annealed silicon steel strip of excellent quality, it is important that the annealing separator have a high level of quality. In order to obtain the high level of quality of the annealing separator, it is important that the process for producing the annealing separator be carried out under suitable conditions.

Usually, the magnesium oxide used in the conventional annealing separator is produced by calcining magnesium hydroxide at a temperature of from 800° to 900° C. It is desirable that the annealing separator contain no impurity, for example, chlorine and sulphur, which will cause the deterioration in quality of the grain oriented silicon steel strip. Therefore the conventional annealing separator is prepared by calcining magnesium hydroxide having a high degree of purity. This magnesium hydroxide causes the resultant annealing separator to be expensive.

The conventional annealing separator consisting of the non-calcined magnesium oxide is soluble in water, and the magnesium oxide dissolved in water is gradually converted into magnesium hydroxide so as to form a stable aqueous colloidal solution. This aqueous colloidal solution of the magnesium hydroxide is effective for stabilizing the aqueous slurry of the magnesium oxide. Also, the aqueous colloidal solution of the magnesium hydroxide promotes the covering activity of the aqueous slurry of the magnesium oxide on the surface of the silicon steel strip. Accordingly, in order to prevent only the sticking of the silicon steel strips to each other, the annealing separator may consist of magnesium hydroxide alone. However, the magnesium hydroxide applied on the surfaces of the silicon steel strips is decomposed so as to produce a large amount of water during the finish annealing operation. The production of water results in reduction of the magnetic property of the silicon steel strip.

Accordingly, the conventional annealing separator is prepared by using a type of magnesium oxide having a reduced solubility in water. This type of magnesium oxide is prepared by calcining magnesium hydroxide at a temperature of from 800° to 900° C. In the case where the above-mentioned type of annealing separator is suspended in water, the magnesium oxide is gradually dissolved in water and, then, the dissolved magnesium oxide is converted into magnesium hydroxide. Several hours after the contact of the magnesium oxide with water, the entire amount of the magnesium oxide is dissolved in the water and converted into magnesium hydroxide. Therefore, when this type of annealing separator is applied onto the silicon steel strip, the content of water in the annealing separator on the silicon steel strip surface changes with the lapse of the storing time of the slurry. This change causes the magnetic property of the resultant annealed silicon steel strip to be changed. In the conventional process, in order to hinder the hydration of the magnesium oxide into the magnesium hydroxide, the aqueous slurry of the annealing separator is stored at a low temperature of from 10° to 20° C. However, the operation for maintaining the temperature of the aqueous slurry at a fixed level causes the application operation of the aqueous slurry of the annealing separator to be complicated and the efficiency of the application operation to be reduced.

SUMMARY OF THE INVENTION

An object of the present invention is to provide an annealing separator for grain oriented silicon steel strips, which is not only cheap, but also, is effective for preventing reduction in the magnetic property of the silicon steel strips during a finish annealing operation.

Another object of the present invention is to provide an annealing separator for grain oriented silicon steel strips, which is easily applied onto the silicon steel strips.

The above-mentioned objects can be attained by the annealing separator of the present invention which comprises non-hydrating magnesium oxide which has been calcined at a temperature of 1300° C. or more and which is in the form of fine particles, 70% by weight or more of which particles have a size of 5 microns or less.

The term "non-hydrating magnesium oxide" used herein refers to a type of magnesium oxide which is substantially not capable of hydrating even when it is brought into contact with water.

DETAILED DESCRIPTION OF THE INVENTION

In the annealing separator of the present invention, it is essential that the magnesium oxide be of the non-hydrating type. The non-hydrating magnesium oxide is prepared by calcining magnesium hydroxide at a temperature of 1300° C. or more, preferably, from 1300° to 2100° C., more preferably, from 1500° to 2100° C. The above-mentioned calcining temperature allows impurities, such as chlorine and sulphur, contained in the magnesium hydroxide to be released in the form of a gas therefrom. Therefore, the magnesium hydroxide to be calcined at the above-mentioned elevated temperature may contain the above-mentioned impurities in a relatively large amount. Also, the calcination at the elevated temperature of 1300° C. or more results in production of the non-hydrating magnesium oxide.

Figure 1:
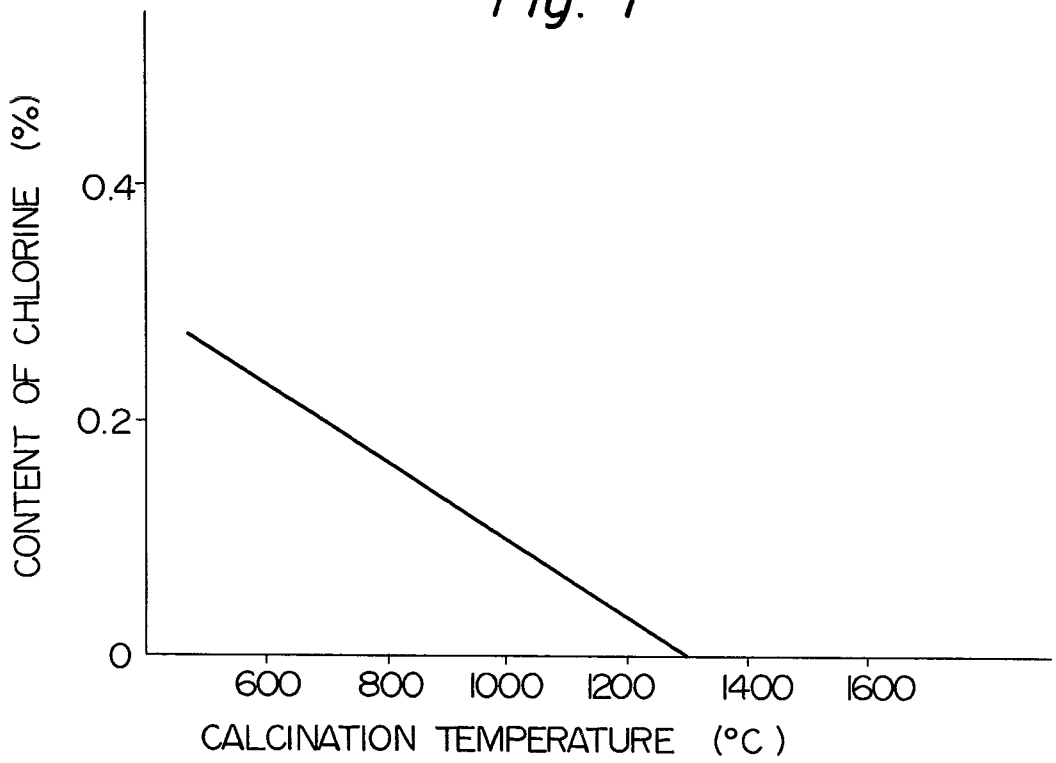
FIG. 1 illustrates a relationship between the calcining temperature applied to magnesium hydroxide and the content of chlorine in the resultant magnesium oxide.

Referring to FIG. 1, the content of chlorine in calcined magnesium oxide decreases as the calcining temperature increases. When the calcination is carried out at a temperature of 1300° C. or more, the content of chlorine in the calcined magnesium oxide becomes zero. That is, the calcining temperature of 1300° C. or more causes the calcined magnesium oxide to contain no chlorine.

It is known that when the conventional type of magnesium oxide, which has been calcined at a temperature of 900° C., is suspended in water at a temperature of 50° C., for 60 minutes, while stirring, to form an aqueous slurry, 78% by weight of the magnesium oxide are dissolved in water and, then, converted into magnesium hydroxide. Also, it is known that just after such suspension, only 10% by weight of the above-mentioned magnesium oxide are dissolved in water. That is, during the storing period of 60 minutes, the amount of the magnesium oxide dissolved in water changes from 10% to 78%. This change results in a change in the amount of water generated in the annealing separator coated on the silicon steel strip during the finish annealing operation. The change in the amount of the generated water causes the magnetic property of the annealed silicon steel strip to be changed.

However, when a magnesium oxide, which has been calcined at a temperature of 1300° C. or more, is suspended in water at a temperature of 50° C., for 60 minutes, only 2% by weight or less of the magnesium oxide is hydrated. That is, the magnesium oxide calcined at a temperature of 1300° C. or more is substantially not capable of hydrating. Accordingly, when the non-hydrating magnesium oxide is used as the annealing separator, the storing period of the aqueous slurry of the annealing separator does not cause a change in the magnetic property of the resultant annealed silicon steel strip.

Figure 2:
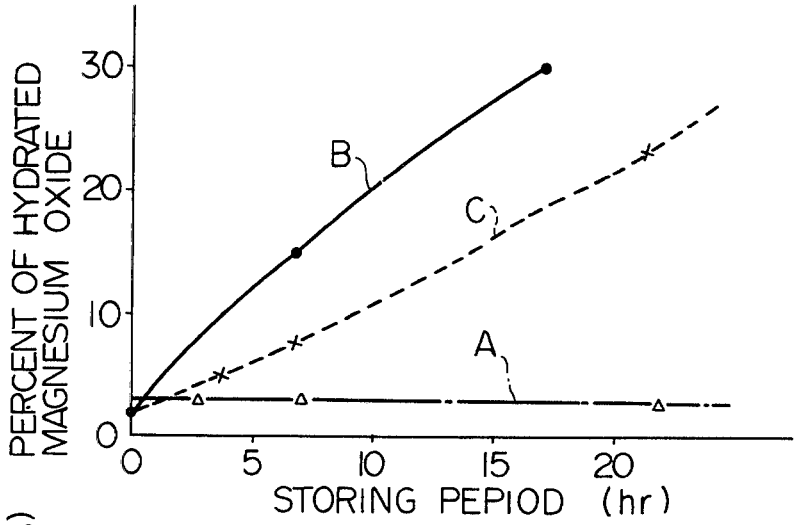
FIG. 2 illustrates a relationship between the storing period in hours of an aqueous slurry of annealing separator and the percent of hydrated magnesium oxide based on the whole amount of the magnesium oxide used.

FIG. 2 illustrates a relationship between the storing period in hours of an aqueous slurry of an annealing separator and the percent of hydrated magnesium oxide based on the entire amount of the magnesium oxide used.

Referring to FIG. 2, in the case where an aqueous slurry is prepared by using a mixture of 90% by weight of a non-hydrating magnesium oxide and 10% by weight of magnesium hydroxide, and the aqueous slurry is stored for 24 hours at a temperature of 30° C., substantially no change in the amount of the hydrated magnesium oxide occurs with the lapse of the storing time of the aqueous slurry. This phenomenon is indicated by Line A in FIG. 2. However, in the case where an aqueous slurry is prepared from a conventional type of magnesium oxide and stored at a temperature of 30° C. for 24 hours, it is indicated by Curve B in FIG. 2 that after about 17 hours of storage, the amount of hydrated magnesium oxide reaches about 30%. Also, Curve C in FIG. 2 indicates that after about 21 hours of storage at a temperature of 15° C., the amount of hydrated magnesium oxide reaches about 22%. Accordingly, in order to hinder the hydration of the conventional type of magnesium oxide, it is necessary to maintain the temperature of the aqueous slurry at a low level of less than 15° C. This necessity causes the storage of the aqueous slurry to be complex and expensive, and, also, the efficiency of the application operation of the aqueous slurry to be poor.

In the annealing separator of the present invention, it is important that the non-hydrating magnesium oxide be in the form of fine particles, 70% by weight of which have a size of 5 microns or less. The conventional (commercially available) type of calcined magnesium oxide is in the form of particles having a large average size of from 30 to 50 microns. The proportion in weight of particles having a size of 5 microns or less to the entire particles is only 20% or less.

When the annealing separator is applied onto the silicon steel strip and, then, subjected to a finish annealing operation, the annealing separator forms a glassy film. This glassy film preferably has a thickness of from 5 to 10 microns. Therefore, in order to form the glassy film having a uniform thickness, it is desirable that the particles of the magnesium oxide have a size as small as possible. Practically, in order to provide a uniform thickness of glassy film, the largest size of the particles of the magnesium oxide should be 20 microns or less. The large size of the magnesium oxide particles causes the magnetic property of the annealed silicon steel strip to be reduced.

Figure 3:
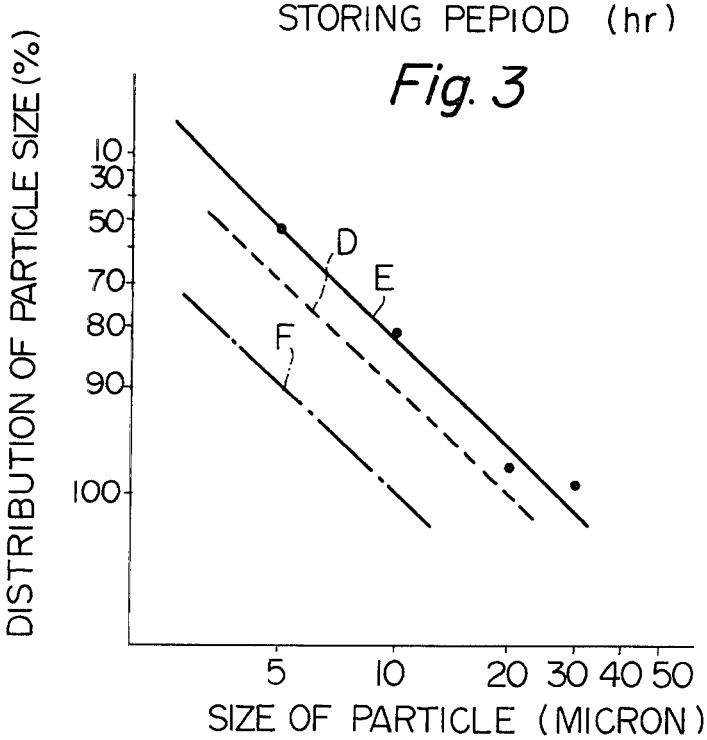
FIG. 3 illustrates a relationship between the size of non-hydrating magnesium oxide particles and the distribution of the particle size.

It is known that, generally, the logarithm of the size in microns of particles is proportional to the logarithm of the distribution in percent of the size of the particles. This relationship is illustrated in FIG. 3. Line D in FIG. 3 indicates that the particles, 70% by weight of which have a size of 5 microns or less, have a size of 20 microns or less. That is in the case of the particles of Line D, the largest size of the particles is 20 microns. Line E in FIG. 3 indicates that in the case of particles, 53% of which have a size 5 microns or less, the largest size is about 30 microns. Therefore, the particles of Line E are not suitable for producing the glass film having a thickness of 10 microns or less. Line F in FIG. 3 indicates that in the case of particles, 90% by weight of which have a size of 5 microns or less, the largest size of the particles is about 10 microns. That is, the particles of Line F are very suitable for producing the glass film having a thickness of 10 microns or less. Also, it is known that in the case of particles, 50% by weight of which have a size of 5 microns or less, the largest size of the particles is about 40 microns. Therefore, if this type of particles are used for producing the glassy film, the resultant film will be uneven and have a number of pin holes, and will cause the magnetic property of the annealed silicon steel strip to be remarkably reduced.

FIG. 3 also indicates that in the case of particles of Line D, 70% by weight of which have a size of 5 microns or less, 90% by weight of the particles have a size of 10 microns or less.

As stated above, in order to produce the glassy film having an even thickness of from 5 to 10 microns, it is important that the non-hydrating magnesium oxide be in the form of fine particles, and that a portion of the particles having a size of 5 microns or less, corresponds to 70% by weight or more of the entire particles. The importance of this feature will be further described below with reference to FIG. 4.

Figure 4:
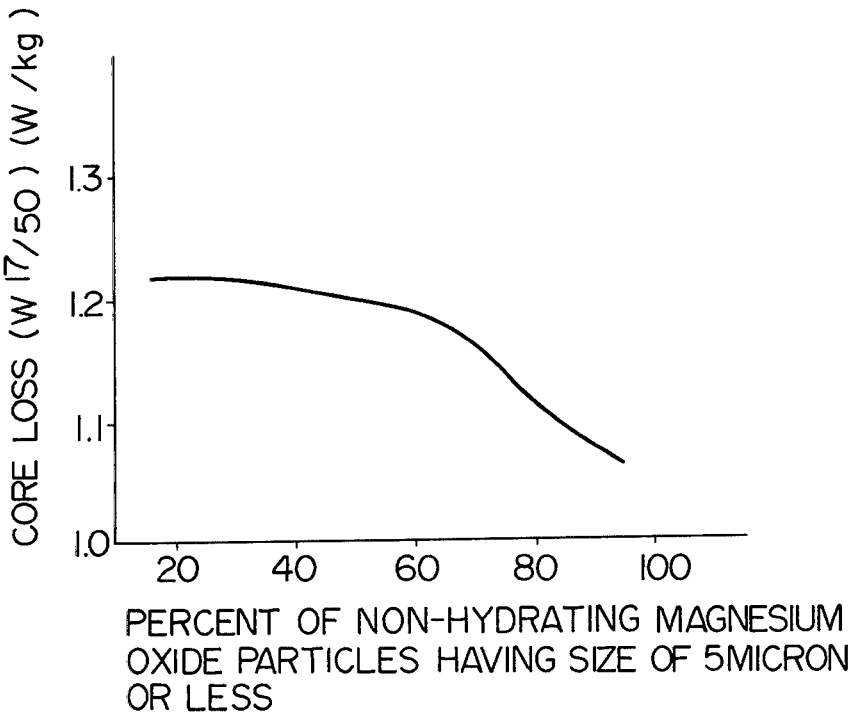
FIG. 4 illustrates a relationship between the percent of a fraction consisting of the non-hydrating magnesium oxide fine particles having a size of 5 microns or less, based on the whole amount of the magnesium oxide fine particles, and the core loss of the resultant grain oriented silicon steel strip.

In FIG. 4 which illustrates a relationship between the percent of a fraction consisting of the magnesium oxide particles having a size of 5 microns or less based on the entire amount of the particles and the value of core loss (W 17/50) of a grain oriented silicon steel strip which has been annealed by using the magnesium oxide particles. As is clear from FIG. 4, the magnesium oxide particles, 70% by weight or more of which have a size of 5 microns or less, cause the annealed steel strip to exhibit an excellent magnetic property.

The non-hydrating magnesium oxide particles usable for the present invention can be prepared by pulverizing magnesium oxide which has been calcined at a temperature of 1300° C. or more, by using any conventional pulverizing apparatuses. However, it is important that the pulverizing operation not result in the contamination of the magnesium oxide particles with an impurity or impurities. Sometimes the impurity is derived from the wearing of the inside surface of the pulverizing vessel and the outer surface of pulverizing rods or balls. For example, when the pulverizing vessel rods and balls are made of steel, the pulverized magnesium oxide particles are contaminated with iron. The contamination with iron results in deterioration in the magnetic property of the annealed steel strip. This deterioration is remarkable, especially in the case of a grain oriented silicon steel strip having a high magnetic flux density. Accordingly, the pulverizing operation should be finished within as short a time as possible. The pulverizing operation for the calcined non-hydrating magnesium oxide may be carried out either by a dry method which is carried out in the air atmosphere or by a wet method which is carried out by suspending the magnesium oxide in water. In the case of the dry method, the contamination of the pulverized magnesium oxide particles with iron is small. Therefore, the dry pulverizing operation may be carried out by using the pulverizing vessel, balls and rods made of steel. However, since the dry method needs a very long time to complete the pulverizing operation, the dry method is not suitable for use industrially. Compared with the dry method, the wet method is effective for completing the pulverizing method within a short period of time. However, the wet method results in a remarkable contamination of the pulverized magnesium oxide particles with iron. The amount of iron contained in the magnesium oxide particles pulverized by the wet method is about ten times that by the dry method. This remarkable contamination with iron results in a significant reduction in the magnetic property of the grain oriented silicon steel strip. In order to prevent the contamination with iron, it is preferable to use a pulverizing vessel and pulverizing balls or rods respectively made of porcelain which contains oxides of aluminium and silicon. If the pulverized magnesium oxide particles are contaminated with the above-mentioned oxide, the oxides do not influence the magnetic property of the annealed silicon steel strip.

Accordingly, it is preferable that the pulverizing operation for the non-hydrating magnesium oxide be carried out by a wet method by using a pulverizing vessel and pulverizing balls or rods respectively made of porcelain. The resultant pulverized magnesium oxide particles exhibit no influence on the magnetic property of the annealed grain oriented silicon steel strip.

The annealing separator of the present invention may contain, in addition to the non-hydrating magnesium oxide, at least one member selected from the group consisting of magnesium hydroxide in an amount of from 1 to 100% based on the weight of the magnesium oxide, and aluminium compounds in an amount of from 0.05 to 10% based on the weight of said magnesium oxide.

The magnesium hydroxide and the aluminium compounds are effective for stabilizing the suspension of the non-hydrating magnesium oxide particles in water.

The magnesium hydroxide is dissolved in water and adsorbed on the surfaces of the non-hydrating magnesium oxide particles suspended in water. The adsorbed magnesium hydroxide on the suspended magnesium oxide particle surfaces creates an electric repulsive force for repulsing the suspended magnesium oxide particles from each other. That is, the electric repulsive force is effective for preventing the aggregation of the suspended magnesium oxide particles with each other and for maintaining the suspension of the magnesium oxide particles in water in a stable condition. The amount of magnesium hydroxide is preferably in the range of from 1 to 100% based on the weight of the magnesium oxide. This is because less than 1% of magnesium hydroxide sometimes cannot completely stabilize the suspension of the non-hydrating magnesium oxide particles in water and more than 100% of magnesium hydroxide sometimes couse the magnetic property of the annealed grain oriented silicon steel strip to be deteriorated due to the formation of a large amount of water during the annealing operation. The magnesium hydroxide usable for the present invention may be replaced by magnesium oxide which has been produced by calcining magnesium hydroxide at a lower temperature than 900° C. and which is capable of easily dissolving in water.

The aluminium compound effective for stabilizing the aqueous suspension of the non-hydrating magnesium oxide particles, may be selected from the group consisting of aluminium hydroxide and aluminium nitrate, which are soluble in water, aluminium silicate, which is contained, for example, in bentonite and clay, and which is insoluble in water, and aluminium oxide and aluminium sulfide. The aluminium silicate or the aluminium silicate containing materials are used in the form of fine particles or of colloidal particles. It is preferable that the aluminium compounds be used in an amount of from 0.05 to 10%, more preferably, 0.1 to 1%, based on the weight of the non-hydrating magnesium oxide. The aluminium compounds are also adsorbed on the surfaces of the non-hydrating magnesium oxide particles and create the electric repulsive force so as to stabilize the aqueous suspension of the magnesium oxide particles. The stabilizing effect of the aluminium compounds is greater than that of the magnesium hydroxide. Therefore, the amount of the aluminium compounds which must be used is smaller than that of the magnesium hydroxide. However, an amount of the aluminium compounds of less than 0.05% may sometimes result in poor the stability of the aqueous suspension of the magnesium oxide particles. Also, an amount of the aluminium compounds of more than 10% may sometimes result in the poor magnetic property of the annealed grain oriented silicon steel strip containing aluminium and nitrogen (AlN), because the large amount of aluminium compounds in the annealing separator may deteriorate the secondary recrystallization of the grains during the annealing operation.

The annealing separator of the present invention may contain, in addition to the non-hydrating magnesium oxide, magnesium nitrate which is effective for stabilizing the aqueous suspension of the magnesium oxide particles. The magnesium nitrate may be used in an amount of from 1 to 100% based on the weight of the magnesium oxide. However, it is preferable that the annealing separator of the present invention contain no magnesium chloride and no magnesium sulfate which hinder the formation of the insulating glassy film from the annealing separator.

The annealing separator of the present invention may contain, in addition to the non-hydrating magnesium oxide, and the magnesium hydroxide and/or the aluminum compounds, at least one boron compound selected from the group consisting or boric acid and borate compounds, in an amount of 2.5% or less based on the weight of the magnesium oxide.

The boron compounds are adsorbed on the surfaces of the non-hydrating magnesium oxide particles suspended in water so as to promote the stability of the aqueous suspension of the magnesium oxide particles. Also, the boron compounds are effective for enhancing the coating property of the aqueous suspension of the annealing separator on the silicon steel strip. Furthermore, the boron compounds are effective for improving the magnetic property of the grain oriented silicon steel strip. Usually, the grain oriented silicon steel strip coated with the annealing separator is annealed in a reducing atmosphere containing hydrogen and nitrogen, at an elevated temperature, so as to promote the secondary recrystallization of the grains. However, in a case where the silicon steel strip contains AlN as an inhibiter, the silicon steel strip sometimes absorbs nitrogen. The AlN in the steel strip obstructs the secondary recrystallization of the grains during the annealing operation. This results in formation of fine grains in the steel strip. The fine grains result in a poor magnetic property of the annealed grain oriented silicon steel strip.

The boron compounds applied onto the surface of the silicon steel strip can hinder the absorption of nitrogen by the silicon steel strip. Accordingly, the amount of the AlN in the silicon steel strip can be controlled by applying the boron compounds onto the surface of the silicon steel strip. In the other words, the secondary recrystallization in the annealing operation, can be regulated by the application of the boron compounds.

In order to attain the above-mentioned effect, the boron compounds are used preferably in an amount of 2.5% based on the weight of the non-hydrating magnesium oxide, more preferably, in an amount of 0.01 to 0.3% in terms of boron, based on the weight of the magnesium oxide.

The boron compound can be selected from the group consisting of boric acid and borate compounds. The borate compound can be selected from the group consisting of sodium borate, borax, potassium borate, magnesium borate and lithium borate.

The annealing separator of the present invention may contain, in addition to the non-hydrating magnesium oxide and the magnesium hydroxide and/or the aluminium compounds, at least one sodium compound in an amount of from 0.005 to 0.2% in terms of sodium, based on the weight of the magnesium oxide. The sodium compound is effective for decreasing the core loss of the grain oriented silicon steel strip. Generally, when the annealing separator containing the non-hydrating magnesium oxide is applied onto the silicon steel strip and, then, subjected to the annealing operation at an elevated temperature, the resultant glass film contains forsterite ($Mg_2SiO_4$) as a main component. However, when the annealing separator contains the sodium compound, the crystals of the non-hydrating magnesium oxide are combined with each other so as to create a large tension on the silicon steel strip. It is known that the application of tension to a grain oriented silicon steel strip in a >001< direction results in a significant decrease in core loss of the silicon steel strip. Therefore, the creation of the large tension on the silicon steel strip due to the presence of the sodium compound in the annealing separator results in a significant decrease in the core loss.

The sodium compound is preferably used in an amount of from 0.005 to 0.2% in terms of sodium, based on the weight of the non-hydrating magnesium oxide. If the sodium compound is used in an amount of less than 0.005% in terms of sodium, the resulting decreasing effect in the core loss will be very small. If the amount of the sodium compound is more than 0.2% in terms of sodium, the resulting glassy material will exhibit such a remarkably decreased melting point that the glassy material can not form a film during the annealing operation. This phenomenon will result in an increase in core loss of the grain oriented silicon steel strip.

The sodium compound usable for the present invention may be selected from the group consisting of sodium hydroxide, sodium sulfide and sodium thiosulfate.

The annealing separator of the present invention may contain, in addition to the non-hydrating magnesium oxide, and the magnesium hydroxide and/or the aluminium compound, at least one boron compound selected from the group consisting of boric acid and borate compounds, in an amount of 2.5% or less based on the weight of the magnesium oxide, and at least one sodium compound in an amount of from 0.005 to 0.2% in terms of sodium, based on the weight of the magnesium oxide.

The annealing separator of the present invention may contain titanium dioxide in an amount of 20% in terms of titanium, based on the weight of the non-hydrating magnesium oxide. The titanium dioxide is effective for stabilizing the aqueous suspension of the magnesium oxide particles and enhancing the magnestic property of the grain oriented silicon steel strip.

The annealing separator of the present invention may contain at least one lithium compound in an amount of from 0.02 to 0.7% in terms of lithium, based on the weight of the non-hydrating magnesium oxide. The lithium compound may be, for example, lithium hydroxide. The lithium compound is effective for enhancing the magnetic flux density of the grain oriented silicon steel strip.

The annealing separator of the present invention may contain at least one potassium compound in an amount of 0.005 to 0.2% in terms of potassium, based on the weight of the non-hydrating magnesium oxide. The potassium compound may be, for example, potassium hydroxide, and is effective for decreasing the core loss of the grain oriented silicon steel strip.

The annealing separator of the present invention is usually applied in the form of an aqueous suspension (slurry) onto the surface of the grain oriented silicon steel strip.

The aqueous slurry of the annealing separator can be prepared by stirring a mixture of the annealing separator and water by using a stirrer.

Usually, the fine particles of the non-hydrating magnesium oxide are not completely independent from each other. That is, a plurality of the fine particles are flabbily aggregated with each other to form a pseudo aggregate particle. The suspension of the aggregate particles in water is very unstable. Therefore, in order to provide a stable aqueous slurry of the annealing separator of the present invention, it is necessary to divide the aggregate particles into fine particles separate from each other in water. Also, in order to stabilize the aqueous suspension of the separate fine particles of the magnesium oxide, it is preferable that the magnesium hydroxide and/or the aluminium compound, as the suspension stabilizer, be uniformly absorbed on the fine particles of the magnesium oxide.

In order to prepare the aqueous slurry in which the suspended fine particles of the non-hydrating m. gnesium oxide are separate from each other, it is preferable that the mixture of the non-hydrating magnesium oxide with water be stirred by using a stirring impeller. The stirring impeller comprises a rotating shaft and a plurality of blades extending outward from the shaft. When the stirring impeller is used, it is preferable that the speed of the impeller measured at an end of a blade be 700 m/min. or more. If the speed is less than 700 m/min., the aggregate particles may not be completely divided into the separate fine particles, and the resultant aqueous slurry may exhibit a poor adhesion on the grain oriented silicon steel strip surface. This phenomenon will be illustrated in detail by the following experiment while referring to FIG. 5.

A mixture of 90 g of non-hydrating magnesium oxide, 10 g of magnesium hydroxide, 0.3 g of borax and 500 m of water was stirred by using a propeller type stirrer. The diameter of the stirrer was 42 mm. The stirrer was rotated at a rate of 4000, 6000 or 8000 rpm, which corresponds to a speed of 528 m/min, 791 m/min or 1056 m/min, measured at an end of the propeller blade, for 60 minutes or 30 minutes. The resultant aqueous slurry was coated in an amount of 15 g/m$^2$ onto a surface of a silicon steel strip. The coated aqueous slurry layer was dried at a temperature of 250° C. so as to form a dry layer of the annealing separator. The intensity of adhesion of the resultant dry layer was determined by reciprocally rubbing the dry layer with a cotton fabric under a load of 100 g. The intensity of adhesion of the dry layer was expressed by the number of the reciprocal rubbing operations necessary to remove a portion of the dry layer so as to cause a portion of the silicon steel strip surface to be exposed to the atmosphere. That is, the larger the number of reciprocal rubbing operations, the higher the intensity of adhesion of the annealing separator. It was considered satisfactory if the dry layer of the annealing separator exhibited an intensity of adhesion (number of rubbing operations) of 10 or more.

Figure 5:
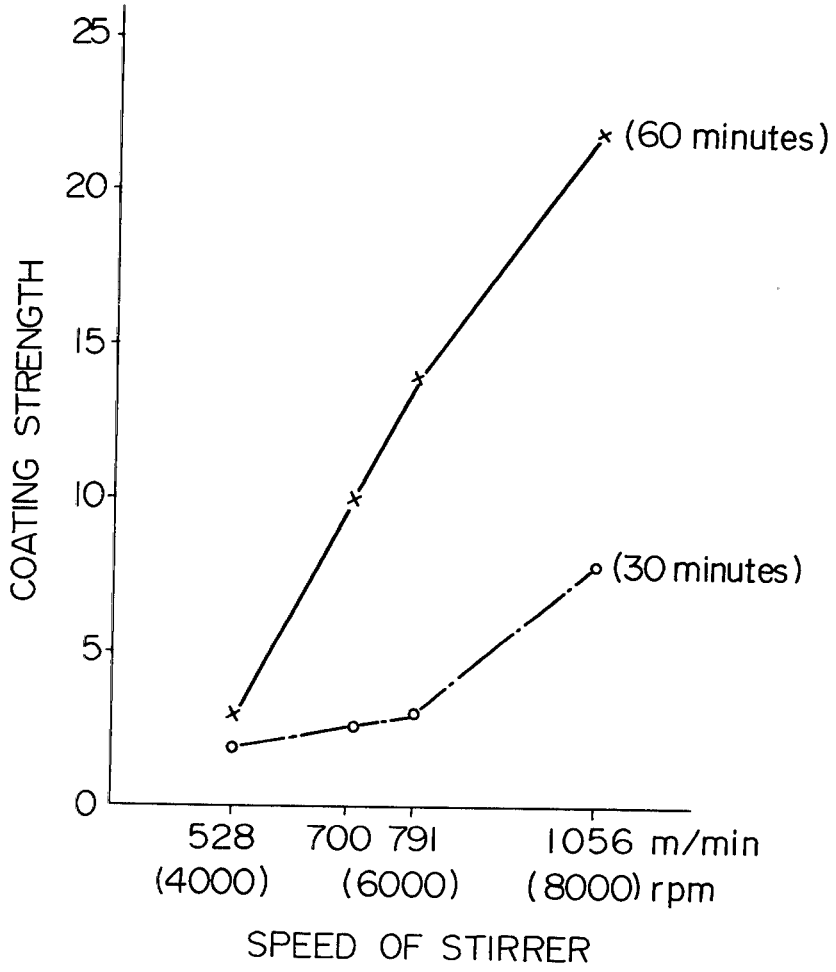
FIG. 5 illustrates the relationship between the speed of a stirring impeller used for preparing an aqueous slurry of an annealing separator and the coating strength of the resultant annealing separator layer on a surface of a grain oriented silicon steel strip.

The results of the experiment are shown in FIG. 5.

FIG. 5 indicates that when the stirring is carried out at a speed of 528 m/min (4000 rpm), for 60 minutes or 30 minutes, the resultant annealing separator exhibits a very poor coating strength of 2 or 3 on the silicon steel strip surface. In this case, the dry layer of the annealing separator is easily pealed off from the surface of the silicon steel strip when the dry layer is brought into contact with, for example, a roller. This phenomenon sometimes causes the silicon steel strip to be stuck to other strips.

In the stirring operation at a speed of 528 m/min (4000 rpm), the aggregate particles of the non-hydrating magnesium oxide particles rotate in the same speed as that of the stirrer. Therefore, the aggregate particles cannot be divided into the fine particles independent from each other. In this case, since the suspension stabilizer, such as the magnesium hydroxide and the aluminium compound, is adsorbed on the surfaces of the aggregate particles, the resultant annealing separator exhibits a poor adhesion on the silicon steel strip.

FIG. 5 also indicates that when the stirrer is rotated at a speed of 791 m/min (6000 rpm) for 60 minutes, the resultant dry layer of the annealing separator exhibits a satisfactory intensity of adhesion of 14. Furthermore, FIG. 5 indicates that a speed of 1056 m/min (8000 rpm) of the stirrer results in an excellent adhesion (of 22) of the resultant dry layer of the annealing separator. Moreover, FIG. 5 indicates that, in order obtain a satisfactory intensity of adhesion of 10 or more of the dry layer of the annealing separator by a stirring operation for 60 minutes or less, it is necessary to rotate the stirrer at a speed of 700 m/min or more.

When the stirrer is rotated at a speed of 700 m/min or more, the speed of the stirrer is higher than that of the aggregate particles of the non-hydrating magnesium oxide particles. Therefore, the aggregate particles are divided into separate fine particles by the impacting action of the impellers of the stirrer applied on the aggregate particles. Also, the suspension stabilizer can be adsorbed on the separate fine particles within a short time.

In order to obtain a coating strength of 10 or more, the stirring operation at a speed of 791 m/min should be carried out for 50 minutes or more, and the stirring operation at a speed of 1056 m/min should be continued for a period of 35 minutes or more.

It is important, in order to provide an annealing separator capable of exhibiting a satisfactory adhesion that the aggregate particles of the non-hydrating magnesium oxide suspended in water be mechanically divided into fine particles by the impacting action of the blades of the impeller. The intensity of the impacting action is proportional to the speed of the end of the blade of the stirrer. The speed of the end of the blade is proportional to the diameter of the stirrer. Accordingly, the speed of 700 m/min can be obtained either by rotating a stirrer having a diameter of 42 mm at a rotating rate of about 5300 rpm or by rotating a stirrer having a diameter of 82 mm at a rotating rate of about 2700 rpm.

The stirring impeller can be selected from any of the conventional impellers, for example, propeller type stirring devices, paddle type stirring devices and turbine type stirrers.

The present invention will now be further illustrated by the following examples, which are not intended to limit the scope of the present invention in any way.

EXAMPLE 1

A silicon steel strip consisting of 0.03% by weight of carbon, 3.1% by weight of silicon, 0.080% by weight of manganese, 0.010% by weight of phosphorus, 0.025% by weight of sulphur and the balance consisting of iron, was cold rolled so as to adjust the thickness of the strip to 0.30 mm. The cold rolled strip was subjected to a decarburization annealing process in an atmosphere consisting of about 75 molar % of hydrogen, about 25 molar % of nitrogen and a small amount of water vaper, and then, cooled to room temperature.

An aqueous slurry of an annealing separator was prepared by wet pulverizing a mixture of 80 g of non-hydrating magnesium oxide which had been calcined at a temperature of 1700° C. and which was in the form of fine particles, 75% by weight of which had a size of 5 microns or less, in 700 g of water. The pulverizing operation was carried out by using a ball mill made of iron. The resulting aqueous slurry of the annealing separator was coated in an amount of 10 g/m$^2$ onto a surface of the silicon steel strip, and then, dried at a temperature of 250° C. The coated silicon steel strip was subjected to a finish annealing at a temperature of 1200° C.

In the silicon steel strip having the above-mentioned composition, secondary recrystallization of grains during the finish annealing was promoted by MnS.

The properties of the resulting grain oriented silicon steel strip are shown in Table 1.

EXAMPLE 2

The same procedures as those mentioned in Example 1 were carried out except that the annealing separator contained 20 g of magnesium hydroxide, in addition to 80 g of the non-hydrating magnesium oxide, and the aqueous slurry of the annealing separator was applied in an amount of 15 g/m$^2$ onto the surface of the silicon steel strip.

The properties of the resulting grain oriented silicon steel strip are shown in Table 1.

EXAMPLE 3

The same procedures as those described in Example 1 were carried out, except that the annealing separator containing 96 g of non-hydrating magnesium oxide, which had been calcined at a temperature of 1500° C. and which was in the form of fine particles, 85% by weight of which had a size of 5 microns or less, and 4 g of aluminium nitrate, was suspended in 600 g of water. The resulting aqueous slurry was applied in an amount of 13 g/m$^2$ onto a surface of the silicon steel strip.

The properties of the resulting grain oriented silicon steel strip are shown in Table 1.

EXAMPLE 4

Procedures identical to those described in Example 1 were carried out, except that aqueous slurry of the annealing separator was prepared by wet pulverizing a mixture of 90 g of non-hydrating magnesium oxide which had been calcined at a temperature of 1400° C. and which was in the form of fine particles, 95% by weight of which had a size of 5 microns or less, 10 g of magnesium hydroxide and 0.3 g of sodium borate in 700 g of water. The resulting aqueous slurry was applied in an amount of 10 g/m$^2$ onto the silicon steel strip surface.

The properties of the resulting grain oriented silicon steel strip are shown in Table 1.

EXAMPLE 5

Procedures identical to those described in Example 1 were carried out, except that the use of the aqueous slurry of the annealing separator was prepared by the following method.

A non-hydrating magnesium oxide, which had been calcined at a temperature of 2000° C., was dry pulverized by using a ball mill. The resulting fine particles of the non-hydrating magnesium oxide contained 80% by weight of a fraction consisting of fine particles having a size of 5 microns or less. A mixture of 90 g of the fine particles of the non-hydrating magnesium oxide, 10 g of magnesium hydroxide, 0.3 g of sodium borate and 700 g of water was vigorously stirred by using a high speed impeller stirrer at a speed of 924 m/min for 60 minutes.

The resulting aqueous slurry was applied in an amount of 12 g/m$^2$ onto the surface of the silicon steel strip.

The properties of the resulting grain oriented silicon steel strip are indicated in Table 1.

TABLE 1

| Example No. | Property of Grain Oriented Silicon Steel Strip: Magnetic flux density (B8) (T) | Core loss (W 17/50) (W/kg) |
|---|---|---|
| 1 | 1.807 | 1.40 |
| 2 | 1.825 | 1.35 |
| 3 | 1.827 | 1.30 |
| 4 | 1.844 | 1.22 |
| 5 | 1.824 | 1.30 |

EXAMPLE 6

An aluminium-containing silicon steel strip consisting of 0.04% by weight of carbon, 2.9% by weight of silicon, 0.08% by weight of manganese, 0.010% by weight of phosphorus, 0.025% by weight of sulphur, 0.027% by weight of aluminium, 0.0080% by weight of nitrogen and the balance consisting of iron, was cold rolled so as to adjust the thickness of the strip to 0.30 mm. Then the strip was subjected to a decarburization annealing in an atmosphere comprising about 75 molar % of hydrogen, about 25 molar % of nitrogen and a small amount of water vaper, at a temperature of 850° C.

An aqueous slurry of an annealing separator was prepared by wet pulverizing a mixture of 90 g of a non-hydrating magnesium oxide, which had been calcined at a temperature of 1700° C. and which was in the form of fine particles containing therein 90% by weight of a fraction which consisted of particles having a size of 5 microns or less, in 700 g of water. The pulverizing operation was carried out by using a ball mill made of alumina.

The aqueous slurry was coated in an amount of 10 g/m$^2$ on a surface of the aluminium-containing silicon steel strip, and dried at a temperature of 250° C. The coated steel strip was finish annealed at a temperature of 1200° C. During the finish annealing operation, the secondary recrystallization of grains was promoted by AlN.

The properties of the resulting grain oriented, aluminium-containing silicon steel strip are indicated in Table 2.

EXAMPLE 7

The same procedures as those described in Example 6 were carried out, except that the aqueous slurry of the annealing separator contained, in addition to 90 g of the non-hydrating magnesium oxide, 10 g of magnesium hydroxide and 0.4 g of sodium borate, and the aqueous slurry was applied in an amount of 15 g/m$^2$ onto the steel strip surface.

The properties of the resulting grain oriented, aluminium-containing silicon steel strip are indicated in Table 2.

EXAMPLE 8

The same procedures as those described in Example 7 were conducted, except that the aqueous slurry of the annealing separator was prepared by wet pulverizing, in 700 g of water, a mixture of 100 g of non-hydrating magnesium oxide, which had been calcined at a temperature of 1800° C. and which was in the form of fine particles, 85% by weight of which had a size of 5 microns or less, 0.5 g of aluminium nitrate and 0.5 g of boric acid.

The properties of the resulting grain oriented, aluminium-containing silicon steel strip are indicated in Table 2.

EXAMPLE 9

Procedures identical to those described in Example 6 were carried out, except that the aqueous slurry of the annealing separator was prepared in the following manner.

A non-hydrating magnesium oxide, which had been calcined at a temperature 2000° C., was dry pulverized by using a ball mill made of alluminium oxide. The resultant fine particles of magnesium oxide contained therein 90% by weight of a fraction consisting of very fine particles having a size of 5 microns or less. Thereafter, a mixture of 80 g of the dry pulverized non-hydrating magnesium oxide, 20 g of magnesium hydroxide, 0.5 g of boric acid and 0.15 g of sodium hydroxide was vigorously stirred by using a high speed impeller stirrer, at a speed of 924 m/min, for 60 minutes. The resultant aqueous slurry was applied in an amount of 12 g/m$^2$ onto a steel strip surface.

The properties of the resulting grain oriented, aluminium-containing silicon steel strip are indicated in Table 2.

EXAMPLE 10

The same procedures as those described in Example 6 were carried out, except that the aqueous slurry of the annealing separator was prepared by wet pulverizing a mixture of 80 g of the non-hydrating magnesium oxide, 20 g of magnesium hydroxide and 0.5 g of sodium borate, in 700 g of water, and the resultant aqueous slurry was applied in an amount of 13 g/m$^2$ onto the steel strip surface. The non-hydrating magnesium oxide particles in the aqueous slurry contained 97% by weight of a fraction consisting of very fine particles having a size of 5 microns or less.

The properties of the resulting grain oriented, aluminium-containing silicon steel strip are indicated in Table 2.

EXAMPLE 11

The same procedures as those described in Example 6 were carried out, except that the aqueous slurry of the annealing separator was prepared by wet pulverizing a mixture of 80 g of the non-hydrating magnesium oxide, 20 g of magnesium hydroxide, 0.10 g of sodium hydroxide, 0.3 g of aluminium nitrate and 0.5 g of boric acid, in 700 g of water.

In the pulverized non-hydrating magnesium oxide in the aqueous slurry, the content of a fraction consisting of very fine particles of magnesium oxide having a size of 5 microns or less, was 88% by weight.

The properties of the resulting grain oriented, aluminium-containing silicon steel strip are indicated in Table 2.

COMPARISON EXAMPLE 1

The same procedures as those mentioned in Example 6 were carried out, except that the annealing separator consisted of a conventional type of magnesium oxide and in the resultant aqueous slurry, the magnesium oxide was completely hydrated and converted into magnesium hydroxide.

The properties of the resulting grain oriented, aluminium-containing silicon steel strip are indicated in Table 2.

TABLE 2

| Example No. | Property of Grain Oriented Silicon Steel Strip: Magnetic flux density ($B_8$) (T) | Core loss (W 17/50) (W/kg) |
|---|---|---|
| 6 | 1.860 | 1.58 |
| 7 | 1.926 | 1.15 |
| 8 | 1.927 | 1.20 |
| 9 | 1.930 | 1.12 |
| 10 | 1.920 | 1.20 |
| 11 | 1.912 | 1.18 |
| Comparison Example | 1.790 | 1.87 |

EXAMPLE 12

The same procedures as those described in Example 6 were carried out, except that the fine particles of the non-hydrating magnesium oxide which were prepared by wet pulverisation by using the ball mill made of alumina, contained 90% by weight of a fraction consisting very fine particles having a size of 5 microns or less.

The properties of the resulting grain oriented, aluminium-containing silicon steel strip are indicated in Table 3.

EXAMPLE 13

The same procedure as those mentioned in Example 12 were carried out, except that the pulverizing operation was carried out by using a ball mill made of iron.

The properties of the resulting grain oriented, aluminium-containing silicon steel strip are indicated in Table 3.

COMPARISON EXAMPLE 2

The same procedures as those described in Example 12 were carried out, except that the wet-pulverizing operation was omitted. The non-hydrated magnesium oxide contained 35% by weight of a fraction consisting of very fine particles having a size of 5 microns or less.

The properties of the resulting grain oriented, aluminium-containing silicon steel strip are indicated in Table 3.

TABLE 3

| Example No. | Property of Grain Oriented Silicon Steel Strip | |
|---|---|---|
| | Magnetic flux density (B8) (T) | Core loss (W 17/50) (W/kg) |
| 12 | 1.935 | 1.07 |
| 13 | 1.920 | 1.26 |
| Comparison Example 2 | 1.905 | 1.28 |

Table 3 shows that, in the case of the aluminium-containing silicon steel strip, it is preferable that the wet pulverizing operation for the annealing separator be carried out by using a ball mill made of alumina rather than that made of iron. The ball mill made of iron will cause the magnetic property of the resulting grain oriented, aluminium-containing silicon steel strip to be slightly reduced.

Table 3 also shows that the non-hydrating magnesium oxide should be in the form of fine particles, 70% by weight or more of which have a size of 5 microns or less.

As stated above, the annealing separator of the present invention exhibits the following advantages.

1. The annealing separator of the present invention is cheaper than the conventional annealing separator which has been prepared from refined magnesium hydroxide having a high degree of purity.

2. The annealing separator of the present invention causes the resultant grain oriented silicon steel strip to exhibit an enhanced magnetic property.

3. The aqueous slurry of the annealing separator of the present invention can be stored without cooling it.

What we claim is:

1. An annealing separator for grain oriented silicon steel strips, comprising (1) non-hydrating magnesium oxide which has been calcined at a temperature of 1300° C. or more and which is in the form of fine particles, 70% by weight or more of which particles have a size of 5 microns or less, and (2) at least one member selected from the group consisting of magnesium hydroxide in an amount of from 1 to 100%, based on the weight of said magnesium oxide, and aluminum compounds in an amount of from 0.05 to 10%, based on the weight of said magnesium oxide.

2. An annealing separator as claimed in claim 1, wherein the calcining temperature of said magnesium oxide is in a range of from 1300° to 2100° C.

3. An annealing separator as claimed in claim 1, wherein said aluminium compound is selected from the group consisting of aluminium hydroxide, aluminium nitrate, aluminium silicate, aluminium oxide and aluminium sulfide.

4. An annealing separator as claimed in claim 1, containing, in addition to said magnesium oxide and said magnesium hydroxide, and/or said aluminium compounds, at least one boron compound selected from the group consisting of boric acid and borate compounds, in an amount of 2.5% or less, based on the weight of said magnesium oxide.

5. An annealing separator as claimed in claim 1, containing, in addition to said magnesium oxide and said magnesium hydroxide, and/or aluminium compounds, at least one sodium compound in an amount of from 0.005 to 0.2% in terms of sodium, based on the weight of said magnesium oxide.

6. An annealing separator as claimed in claim 1, containing, in addition to said magnesium oxide and said magnesium hydroxide, and/or aluminium compounds, at least one boron compound selected from the group consisting of boric acid and borate compounds, in an amount of 2.5% or less, based on the weight of said magnesium oxide, and at least one sodium compound in an amount of from 0.005 to 0.2% in terms of sodium, based on the weight of said magnesium oxide.

7. An annealing separator as claimed in claim 2, wherein the calcining temperature of said magnesium oxide is in a range of from 1500° to 2100° C.

8. An annealing separator as claimed in claim 4, wherein the amount of said boron compound is in a range of from 0.01 to 0.3% in terms of boron, based on the weight of said magnesium oxide.

9. An annealing separator as claimed in claim 4, wherein said borate compound is selected from the group consisting of sodium borate, borax, potassium borate, magnesium borate and lithium borate.

10. An annealing separator as claimed in claim 9, wherein said sodium compound is selected from the group consisting of sodium hydroxide, sodium sulfide and sodium thiosulfate.

* * * * *

UNITED STATES PATENT AND TRADEMARK OFFICE

CERTIFICATE OF CORRECTION

PATENT NO. : 4,287,006

DATED : Sept. 1, 1981

INVENTOR(S) : HIROMAE, Yoshitaka; NAKAMURA, Kazuo; and NITTO, Hajime

It is certified that error appears in the above—identified patent and that said Letters Patent is hereby corrected as shown below:

Figure 2 of the drawing change "PEPIOD" to"PERIOD".

Column 8, line 30, change >001< to "<001>"

Signed and Sealed this

*Second* Day of *March 1982*

[SEAL]

*Attest:*

GERALD J. MOSSINGHOFF

*Attesting Officer*

*Commissioner of Patents and Trademarks*